US006460740B2

(12) United States Patent
Simard

(10) Patent No.: US 6,460,740 B2
(45) Date of Patent: Oct. 8, 2002

(54) FLUID DISPENSER

(75) Inventor: Marisol Simard, Nyack, NY (US)

(73) Assignee: Valois S.A., Le Neubourg (FR)

( * ) Notice: Subject to any disclaimer, the term of this patent is extended or adjusted under 35 U.S.C. 154(b) by 0 days.

(21) Appl. No.: 10/002,155

(22) Filed: Dec. 5, 2001

(65) Prior Publication Data

US 2002/0070244 A1 Jun. 13, 2002

(30) Foreign Application Priority Data

Dec. 8, 2000 (FR) ..... 00 15994

(51) Int. Cl.[7] ..... B67D 5/40
(52) U.S. Cl. ..... 222/382; 222/464.2
(58) Field of Search ..... 222/382, 464.2, 222/211

(56) References Cited

U.S. PATENT DOCUMENTS 2,950,031 A 10/1960 Abplanalp et al.
3,409,184 A * 11/1968 Stengle, Jr. ..... 222/211
4,148,419 A * 4/1979 MacNair ..... 222/464.2

* cited by examiner

*Primary Examiner*—Philippe Derakshani
(74) *Attorney, Agent, or Firm*—Sughrue Mion, PLLC

(57) ABSTRACT

A fluid dispenser having a reservoir forming a bottom, side walls, and a neck; and a dispensing member, such as a pump or a valve mounted on the neck. The dispensing member is provided with a tube extending inside the reservoir to the point of being in contact with the bottom via its free bottom end. At least over a portion of the tube's length, the tube has a deformation zone that is deformed by the free end of the tube pressing against the bottom.

20 Claims, 1 Drawing Sheet

FLUID DISPENSER

The present invention relates to a fluid dispenser comprising a reservoir serving to contain the fluid, and a dispensing member such as a pump or a valve for extracting and dispensing the fluid contained in the reservoir. Conventionally, the reservoir comprises a bottom, side walls, and a neck on which or in which the dispensing member is mounted. This type of fluid dispenser is in frequent use in the fields of perfumes, cosmetics, or even pharmaceuticals. The pump is actuated manually by pressing on a pusher.

BACKGROUND OF THE INVENTION

To draw off fluid from inside the reservoir, the dispensing member conventionally comprises a tube which extends from its inlet to the bottom of the reservoir. Such a tube is commonly referred to as a "dip tube" and it preferably extends to the point of touching the bottom of the reservoir. However, it can happen that the free end of the dip tube remains spaced apart from the bottom of the reservoir so that not all of the fluid contained in the reservoir can be drawn off through the dip tube. Furthermore, the dip tube is not a particularly aesthetically-pleasing element, and it can even spoil the aesthetic appearance of the dispenser, in particular in the field of perfumes.

Document U.S. Pat. No. 2,950,031 describes a fluid dispenser comprising a reservoir in the form of a can equipped with a cup in which a valve is mounted. The valve includes a dip tube that extends towards the bottom of the can to terminate in a corolla-like skirt. The corolla-like skirt is deformable so as to enable it to be inserted into the can. However, inside the can, the corolla-like skirt relaxes to return to its initial rest state. Once in the final assembly position, the corolla-like skirt is not in contact with the bottom, but rather it remains some distance away, so as to define an annular inlet opening through which the liquid stored in the can, can rise into the dip tube and through said dip tube up to the valve.

OBJECTS AND SUMMARY OF THE INVENTION

An object of the present invention is to improve the aesthetic appearance of the dip tube while also optimizing its capacity to draw off the fluid contained in the reservoir.

To achieve this object, the present invention provides a fluid dispenser comprising:

a reservoir forming a bottom, side walls and a neck; and a dispensing member, such as a pump or a valve mounted on the neck, said member being provided with a tube extending inside the reservoir to the point of being in contact with said bottom via its free bottom end;

wherein, at least over a portion of its length, said tube has a deformation zone which is deformed by the free end of the tube pressing against said bottom. The tube pressing against the bottom of the reservoir guarantees that the tube is properly in contact with the bottom so as to draw off the maximum possible amount of fluid. In addition, the deformation zone makes it possible to compensate for the surplus initial length of the tube that is necessary to ensure that the tube is properly in contact with the bottom. The deformation zone of the tube may advantageously impart an aesthetically-pleasing effect that contributes to the overall appearance of the dispenser. It is possible, by means of a configuration of openings, cutouts, or slots in the tube, to impart an attractive appearance to the deformation zone.

Preferably, the deformation zone has a diameter greater than the diameter of the remainder of the tube, and advantageously greater than the diameter of the neck of the receptacle. It is even possible to dispose a resilient flexible element inside the tube at said deformation zone, which element guides or participates in the visually attractive deformation of the tube.

The tube may be a dip tube, or a tube surrounding a dip tube. When the dip tube extends inside the tube, the dip tube may be spaced apart from the bottom of the reservoir via its free end, i.e. it is the tube surrounding it that forms an extension-like portion that extends to the point of being in contact with the bottom of the reservoir. Advantageously, the tube may have a non-deformed zone between the free end of the dip tube and the bottom of the reservoir. It is thus possible to use the decorative tube that surrounds the dip tube to extend the dip tube, thereby guaranteeing that the dip tube draws off the maximum possible amount of fluid down to the bottom of the reservoir.

BRIEF DESCRIPTION OF THE DRAWING

The invention is described more fully below with reference to the accompanying drawing giving two embodiments of the invention by way of example.

In the figures.

MORE DETAILED DESCRIPTION

Figure 1:
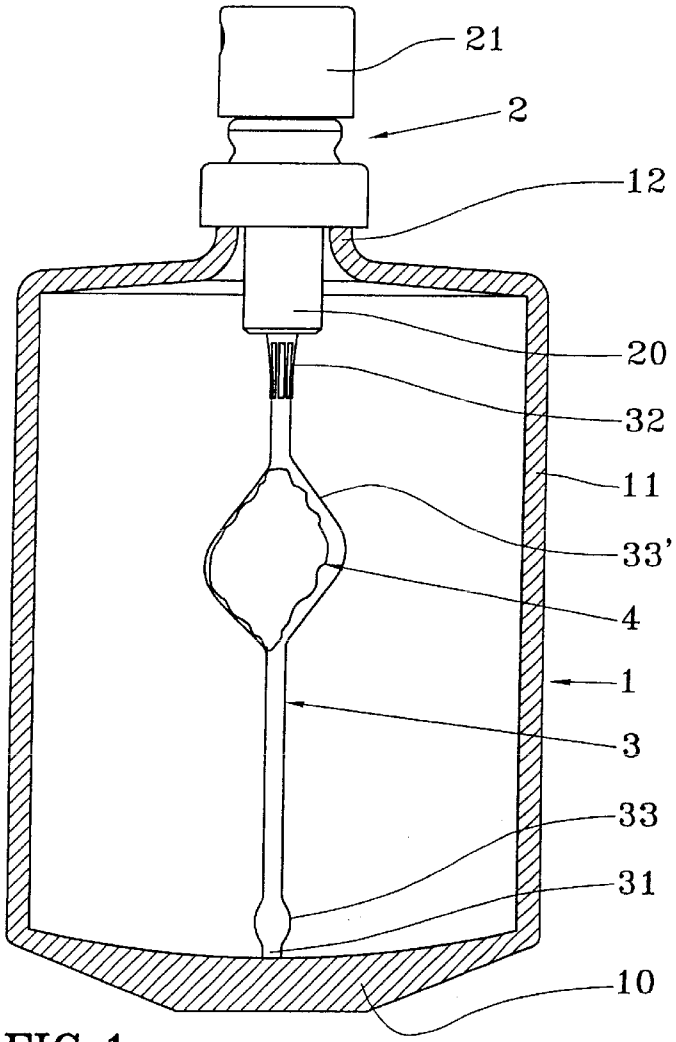
FIG. 1 is a vertical section view through a fluid dispenser of the invention.

The dispenser of the invention shown in FIG. 1 comprises a reservoir 1 defining a bottom 10, side walls 11, and a neck 12. The dispenser further comprises a dispensing member 2, e.g. a pump or a valve, mounted on the neck 12 of the reservoir 1. The dispensing member 2 comprises a body 20 inserted in the neck 12, and a pusher 21 which is situated above the neck 12 and which is pressed to actuate the dispensing member, and thereby to dispense fluid contained in the reservoir 1.

At the bottom end of the body 20 of the dispensing member 2, a tube 3 extends towards the bottom 10 of the reservoir 1. The tube 3 is provided with a top end 32 connected securely and in leaktight manner to the inlet (not shown) of the dispensing member. At its other end 31, the tube 3 is in contact with the bottom 10. It can be seen in FIG. 1 that the tube 3 is provided with two deformation zones 33 and 33'. The diameter of each of these deformations 33, 33' is greater than the diameter of the remainder of the tube, which is advantageously cylindrical. It is possible, however, to consider providing tubes of non-constant diameter. It can be observed that the deformation zone 33' has a diameter greater than the inside diameter of the neck 12.

The zones 33 and 33' are deformed by the free bottom end 31 of the tube 3 pressing against the bottom 10 of the reservoir 1. In the initial state (not shown), the deformation zones 33, 33' are not apparent or are hardly apparent. The tube is then exactly straight or imperceptibly curved, and it extends along a longitudinal axis. It is only when the free end of the tube is pressed against the bottom of the reservoir that the deformation zones appear. Since the free end 31 of the tube 3 comes to press against the bottom 10, the tube is axially stressed, thereby generating a reduction in its length that results in it being deformed at the zones 33 and 33'. The deformation generates no curvature or hardly any curvature of the tube, which remains substantially on its original longitudinal axis. Thus, no bends are formed in the tube.

Figure 2:
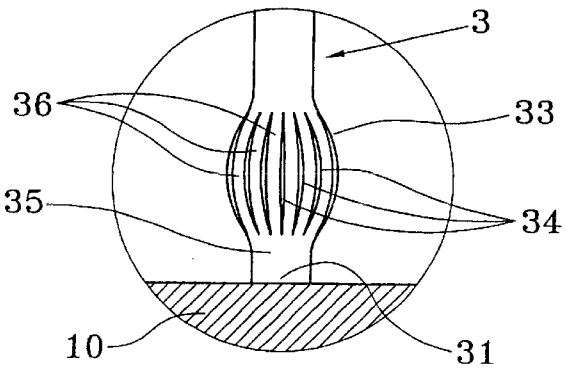
FIG. 2 is an enlarged view of the circled portion of FIG. 1, corresponding to the bottom end of the tube.

To enable the deformation zones 33 and 33' to form at predetermined places along the length of the tube 3, it is necessary to form weakness zones at these predetermined places, thereby facilitating deformation of the tube. For example, these weaknesses may be provided in the form of openings, slots, or notches 34 defining fine flexible blades 36 disposed side-by-side and interconnected at both of their ends to the intact remainder of the tube, as can be seen in FIG. 2. Thrust on the free end of the tube then causes the blades of the deformation zone to buckle outwards, thereby locally increasing the diameter of the tube.

It is even possible to include a resilient flexible element 4 in the deformation zone 33, which element tends to expand inside the tube at the deformation zone whenever said deformation zone is generated by pressing on the free end of the tube. The resilient flexible element 4 does not cause the deformation of the zone 33', but rather it contributes only to shaping the profile of its deformation in visually attractive manner. However, the resilient flexible element 4 must allow a passageway to remain for the fluid.

Figure 3:
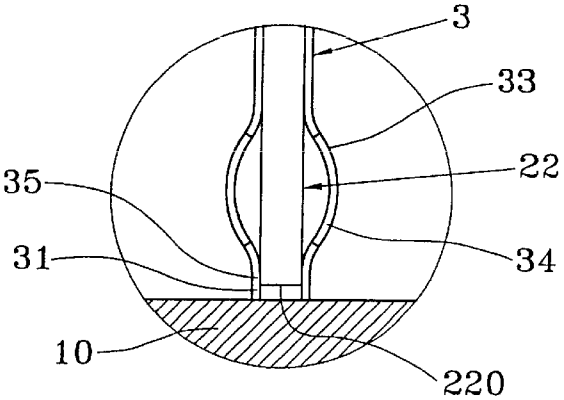
FIG. 3 is a view similar to the FIG. 2 view, showing a variant embodiment in which a dip tube is inserted inside the tube of the invention.

The above-described tube may serve directly as a dip tube, but preferably it serves as a decorative tube inside which a genuine dip tube 22 extends, as can be seen in FIG. 3. The decorative tube 3 then surrounds the dip tube 22, which is itself connected to the inlet of the pump 2 so as to communicate with the chamber of the dispensing member. As can be seen in FIG. 3, the dip tube 22 does not have to extend to the point of its free end 220 being in contact with the bottom 10 of the reservoir 1, but rather it may remain spaced apart from said bottom. The decorative tube 3 may then advantageously serve as an extension to the dip tube 22, via a portion 35 that connects the free end 220 of the dip tube 22 to the bottom 10, with which it is in contact via its bottom end 31. The portion 35 advantageously forms a non-deformed zone of the tube 3 which is contact with the free end 220 of the dip tube 22 over its entire periphery, and advantageously in leaktight manner. In this way, the zone 35 forms a genuine extension to the dip tube 22 which thus does not need to be cut with very high accuracy.

Above the non-deformed zone 35, the decorative tube 3 may form a deformation zone 33 as defined above, i.e. with vertical slots 34 that define strips 36 between them which are bent due to the thrust exerted on the free bottom end 31 of the tube 3. The dip tube 22 is therefore visible in part at said deformation zone 33, and it is advantageously possible to create an aesthetically-pleasing effect by choosing different colors for the dip tube 22 and for the decorative tube 3.

By means of the invention, a traditional dip tube may both be optimized functionally, and also be made visually attractive.

What is claimed is:

1. A fluid dispenser comprising:

a reservoir forming a bottom, side walls and a neck; and a dispensing member mounted on the neck, said dispensing member being provided with a tube extending inside the reservoir to the point of being in contact with said bottom via its free bottom end;

wherein, at least over a portion of a length of said tube, said tube has a deformation zone which is deformed by the free end of the tube pressing against said bottom.

2. A dispenser according to claim 1, in which said zone has a diameter greater than the diameter of the remainder of the tube.

3. A dispenser according to claim 1, in which said zone has a diameter greater than the diameter of the neck.

4. A dispenser according to claim 1, in which said zone is provided with openings.

5. A dispenser according to claim 1, in which a resilient flexible element is disposed inside the tube at said deformation zone.

6. A dispenser according to claim 1, in which said tube serves as a dip tube.

7. A dispenser according to claim 1, in which a dip tube extends inside said tube.

8. A dispenser according to claim 7, in which said dip tube is spaced apart from the bottom of the reservoir via its free end, said tube having a non-deformed zone between the free end of the dip tube and the bottom.

9. A dispenser according to claim 1, in which the deformation of the zone, which deformation is obtained by the pressing of the free end of the tube, is accompanied by a reduction in the length of the tube, which nevertheless remains on a longitudinal axis.

10. A dispenser according to claim 1, in which the zone is provided with slots defining flexible blades between them.

11. The dispenser according to claim 1, wherein said dispensing member is one of a pump and a valve.

12. A fluid dispenser comprising:

a reservoir having a bottom, side walls, and a neck that defines an opening;

a dispensing member disposed within the opening defined by said neck; and a first tube coupled to a bottom of said dispensing member and extending inside said reservoir to a distal end of said first tube, said distal end of said first tube in contact with said bottom;

wherein, said first tube includes a deformation zone that is deformed by compression of said first tube between said dispensing member and said bottom.

13. The fluid dispenser according to claim 12, wherein said first tube is immobile in an axial direction upon activation of said dispensing member to dispense fluid within said reservoir.

14. The fluid dispenser according to claim 12, wherein said dispensing member is a pump.

15. The fluid dispenser according to claim 12, wherein said dispensing member is a valve.

16. The fluid dispenser according to claim 12, wherein a second tube extends inside said first tube, and wherein said dispensing member, upon being actuated, conveys fluid through an entire length of said second tube.

17. The fluid dispenser according to claim 16, wherein a second tube extends inside said first tube along an entire length of said second tube between said dispensing member and said bottom.

18. The fluid dispenser according to claim 16, wherein a distal end of said second tube opposite said dispensing member is spaced apart from said bottom of said reservoir, and wherein said first tube is rigid between a distal end of said second tube opposite said dispensing member and said bottom.

19. The fluid dispenser according to claim 12, wherein said deformation zone is formed of slots defining flexible blades between the slots.

20. The fluid dispenser according to claim 12, wherein said deformation zone is formed by a weakened portion of said first tube, and wherein said weakened portion is an integral one-piece construction of said first tube.

* * * * *